US005435668A

United States Patent [19]

Shibazaki et al.

[11] Patent Number: 5,435,668

[45] Date of Patent: Jul. 25, 1995

[54] METHOD FOR CONTROLLING A FINAL PILE DIAMETER IN A CAST-IN-PLACE OF SOLIDIFICATION PILE BY A JET PROCESS

[75] Inventors: Mitsuhiro Shibazaki, Akazukashinmachi; Hiroshi Yoshida, Tokorozawa, both of Japan

[73] Assignee: Chemical Grouting Co., Ltd., Tokyo, Japan

[21] Appl. No.: 112,065

[22] Filed: Aug. 26, 1993

[51] Int. Cl.[6] ..... E02D 5/34

[52] U.S. Cl. ..... 405/233; 405/269

[58] Field of Search ..... 405/233, 236, 237, 248, 405/269

[56] References Cited

U.S. PATENT DOCUMENTS

| | | | |
|---|---|---|---|
| 1,852,903 | 4/1932 | Salmon | 405/248 |
| 5,256,004 | 10/1993 | Gemmi et al. | 405/237 |
| 5,304,016 | 4/1994 | Kunito | 405/233 |

*Primary Examiner*—David H. Corbin

*Attorney, Agent, or Firm*—Armstrong, Westerman, Hattori, McLeland & Naughton

[57] ABSTRACT

An apparatus for forming a pile having a predetermined pile diameter in a cast-in-place pile includes an agitating apparatus. The agitating apparatus includes a pipe having a longitudinal axis which extends into the ground, and two nozzles are respectively disposed on and supported on the pipe. Each of the plurality of nozzles produces a directional jet flow of liquid. Additionally, an arrangement is provided for supplying liquid under pressure to the two nozzles. The two nozzles are spaced apart a predetermined distance along the longitudinal axis of the pipe, and are oriented such that fluid flow from the two nozzles intersects at a predetermined radial distance from the pipe, so that a cross jet flow is established at the predetermined radial distance to establish an outermost mixing of hardener and settable mixture. A final hardened pile diameter forms at the predetermined radial distance.

4 Claims, 1 Drawing Sheet

METHOD FOR CONTROLLING A FINAL PILE DIAMETER IN A CAST-IN-PLACE OF SOLIDIFICATION PILE BY A JET PROCESS

BACKGROUND OF THE INVENTION

1. Field of the Invention

The present invention relates to a method for controlling a final pile diameter in a cast-in-place pile formed by solidification within the ground by a jet process which includes injecting a settable mixture in a high pressure jet flow into the ground.

2. The Prior Art

The method is known for forming a cast-in-place pile formed by solidification within the ground of a settable material by injecting a settable material in a high pressure jet flow, for improving a soil condition.

As representative such methods, a jet grout method and a chemical charging pile method are discussed below.

The jet grout method is a method for forming a cast-in-place pile formed by solidification of a settable material by injecting a hardening agent in fluid which fills a void created by cutting the ground with the fluid in a super-high pressure jet flow surrounded by air. The chemical charging pile method is a method for forming a cast-in-place pile formed by solidification of a settable material within the ground by injecting a hardening agent into the ground at a super-high pressure while cutting the ground with its destructive force.

Now, in such a known soil improvement method, at an injection of settable material in a high pressure jet flow into the ground, a throw-distance of the material in the jet flow, from a central pipe which injects the settable materials, depends on soil condition and soil properties (strength, water content, void ratio). It was a practice which was preferred in the prior art to produce the final diameter of the cast-in-place pile so that it is somewhat larger than actually required by injecting of water or injecting of the hardening agent with an excessive power.

In the prior method for providing a final diameter of a cast-in-place pile which is somewhat larger than is required by injecting of water or of a hardening agent with an excessive power, there are problems such as loss of material and outflow of a substantial amount of slime, etc.

SUMMARY OF THE INVENTION

Therefore, it is an object of the present invention to solve such a disadvantage as the loss of material, etc., in the prior art methods by providing a method of producing a pile diameter of a cast-in-place pile which is selectable depending on the situation, by selectively controlling a throw-distance of the material in the jet flow from a central pipe.

According to the present invention, in the apparatus for forming cast-in-place pile by solidification of a settable material within the ground by supplying the settable material in a high pressure jet flow which is directed by at least two nozzles connected to receive pressurized material from a pipe inserted into the ground. The nozzles are spaced at a predetermined distance apart along a longitudinal direction of the pipe, for injecting water or a hardening agent. An injection angle of these nozzles relative to the pipe is adjustable prior to insertion into the ground so that the jets therefrom intersect in a cross jet flow at a predetermined distance from the pipe according to a required throw-distance, so as to control the final pile diameter which extends from the pipe to the intersection of the jet flows at the predetermined distance.

It is known that when the fluids injected from two or more delivery ports intersect each other, an energy of the combined jet flow will be reduced depending on their cross angle. It is therefore possible to obtain a predetermined final pile diameter by controlling the throw-distance of the combined jet flow according to the above-described principle.

In the prior art, no provision was made for controlling the final pile diameter on the basis of a fixed relation between an injection flow and a cross-section of the delivery port of a nozzle, etc., so that it was difficult to attain an efficient use of material and a suppression of slime outflow. By using a cross jet flow according to the present invention, a final cast-in-place pile diameter corresponding to a design can be selected freely by a flow rate of hardening agent, by a cross-section of the delivery port as well as by a nozzle angle. While a doubled number of jet flows are required for obtaining a cross flow, the number crossing the soil per unit depth is also doubled, so that an agitating efficiency will be increased greatly by the increased number of jet flows.

DETAILED DESCRIPTION OF THE PREFERRED EMBODIMENT

Figure 1:
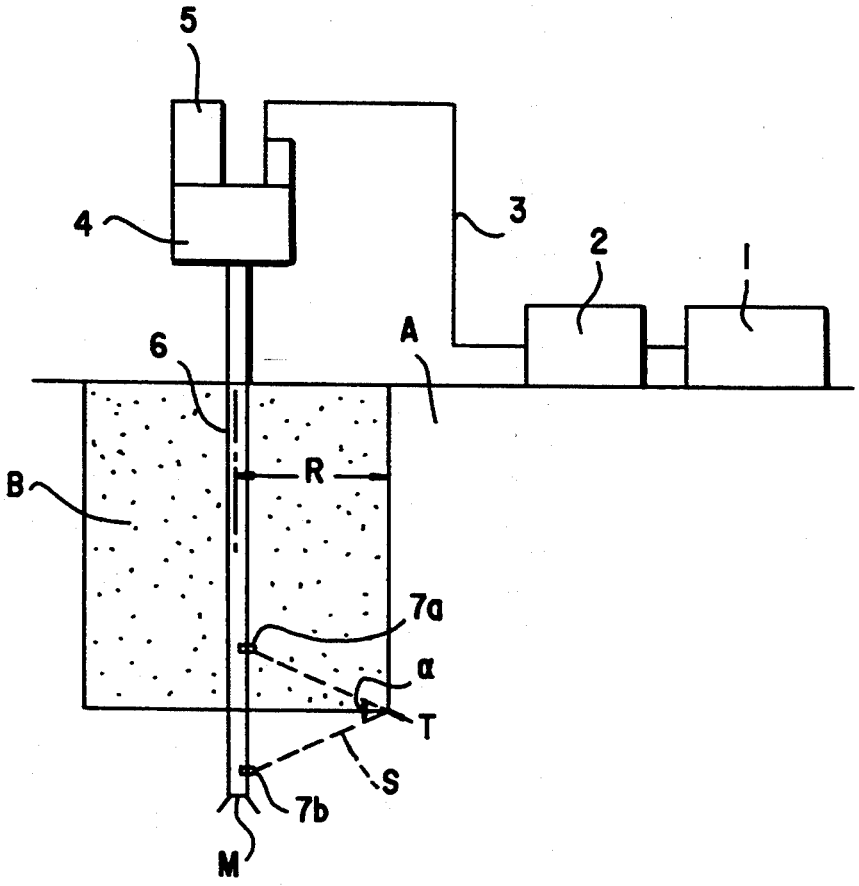
FIG. 1 is a schematic side view of an apparatus used to form a cast-in-place pile using a jet process, by controlling a final diameter of the pile according to the present invention.

An embodiment of the present invention will be explained below with reference to the drawings.

In FIG. 1, a generator 1 provides power to a high pressure pump 2 driven by the generator 1. Piping 3 connects the output of the pump 2 to a swivel joint 4 which is connected to a pipe 6 inserted into the ground A. An agitating process machine 5 is connected to the swivel joint 4. An upper nozzle *7a* and a lower nozzle *7b* are disposed along the pipe 6 at a predetermined spacing along the longitudinal direction of the pipe 6. The nozzles *7a* and *7b* are oriented such that an injection angle of each of these nozzles *7a*, *7b* relative to the pipe 6 is adjustable.

The water or hardening agent is injected into the ground from the nozzles *7a*, *7b*, the water or hardening agent being supplied into the ground A via the swivel joint 4 by the high pressure pump 2. In this case, the hardening agent which is injected can be cement milk, mortar, and a chemical agent. The angle of each of the nozzles *7a* and *7b* relative to the pipe 6 is adjustable prior to insertion of the pipe 6 into the ground, and is preset such that cross jet flows S will be established (such that each of the jet flows from the nozzles *7a* and *7b* will meet at a cross angle $\alpha$). The cross angle $\alpha$ is preset by adjustment of the angles of the nozzles *7a* and *7b* prior to insertion of the pipe 6 into the ground A, to an angle predetermined depending on the desired at the radial distance R.

An injection timing of the jet flow is determined according to the manner of construction, so that the jet flow can be injected when the pipe 6 is advanced or when the pipe 6 is retracted, depending on the situation.

The agitating process machine 5 is displaced either upwards or downwards while the hardening agent is injected from the nozzles *7a* and *7b*, and the pipe 6 is rotated. A column-like cast-in-place pile B is thereby constructed within the ground A, wherein the cast-in-place pile B has its outermost edge at the radial distance R corresponding to a joining point T of the cross flows S as shown in FIG. 1. Depending on the construction method preferred, a hardening agent M can be delivered from the leading end of the pipe 6 at a lower pressure than that at the nozzles *7a* and *7b* (the high pressure portion). In this case, the pump can be divided into two systems of high pressure and low pressure, or alternatively a pressure reduction apparatus can be provided in the pressure piping to the pipe 6.

The above-described method can be applied not only in the chemical charging pile method of injecting a hardening agent from the nozzle, but also to the jet grout method of filling a hardening agent in fluid into a void provided by cutting the ground with water injected from the nozzles *7a* and *7b*.

We claim:

1. A method for controlling a final pile diameter in a cast-in-place pile by a jet process, comprising the steps of:

agitating a settable mixture using a high pressure jet flow produced by nozzles supported by a pipe while injecting a hardening agent within the ground using said pipe, said high pressure jet flow being directed by two nozzles connected to receive pressurized fluid through said pipe, said nozzles being spaced apart a predetermined distance along a longitudinal direction of said pipe, said nozzles being directional and being oriented such that fluid flow from said two nozzles intersects at a location at a predetermined radial distance from said pipe, whereby a cross jet flow is established at said predetermined radial distance to establish an outermost mixing of hardener and settable mixture, whereby a final hardened pile diameter forms at said predetermined radial distance.

2. An apparatus for forming a pile having a predetermined pile diameter in a cast-in-place pile, comprising:

an agitating apparatus comprising:

a pipe having a longitudinal axis which extends into the ground;

two nozzles respectively disposed on and supported said pipe, each of said plurality of nozzles producing a directional jet flow of liquid; and means for supplying liquid under pressure to said two nozzles;

whereby said two nozzles are spaced apart a predetermined distance along said longitudinal axis of said pipe, said nozzles being oriented such that fluid flow from said two nozzles intersects at a predetermined radial distance from said pipe, whereby a cross jet flow is established at said predetermined radial distance to establish an outermost mixing of hardener and settable mixture, whereby a final hardened pile diameter forms at said predetermined radial distance.

3. An apparatus for forming a pile as claimed in claim 2, wherein said cross flow jet is established at a location in a direction of said longitudinal axis which is between said two nozzles.

4. An apparatus for forming a pile as claimed in claim 2, wherein a direction of orientation of each of said nozzles is adjustable in a vertical direction.

* * * * *